US006033492A

United States Patent [19]

Honda et al.

[11] Patent Number: 6,033,492

[45] Date of Patent: Mar. 7, 2000

[54] COMPOSITION AND PROCESS FOR AUTODEPOSITION WITH MODIFYING RINSE OF WET AUTODEPOSITED COATING FILM

[75] Inventors: Takumi Honda; Mutsumi Hirota; Norifumi Hatano, all of Kanagawa-ken, Japan

[73] Assignee: Henkel Corporation, Gulph Mills, Pa.

[21] Appl. No.: 09/000,298

[22] PCT Filed: Jul. 24, 1996

[86] PCT No.: PCT/US96/11833

§ 371 Date: Jan. 26, 1998

§ 102(e) Date: Jan. 26, 1998

[87] PCT Pub. No.: WO97/04880

PCT Pub. Date: Feb. 13, 1997

[30] Foreign Application Priority Data

Jul. 25, 1995 [JP] Japan ..... 7-209215

[51] Int. Cl.[7] ..... C23C 8/00

[52] U.S. Cl. ..... 148/240; 148/245; 148/251; 148/261; 148/262; 148/283; 427/388.1; 427/388.4

[58] Field of Search ..... 148/240, 245, 148/251, 261, 262, 283; 427/388.1, 388.4

[56] References Cited

U.S. PATENT DOCUMENTS

| | | | |
|---|---|---|---|
| 3,585,084 | 6/1971 | Steinbrecher et al. | 427/435 |
| 3,795,546 | 3/1974 | Hall et al. | 427/341 |
| 4,874,673 | 10/1989 | Donovan et al. | 428/463 |
| 5,164,234 | 11/1992 | Siebert | 427/419.8 |
| 5,342,694 | 8/1994 | Ahmed et al. | 428/461 |

FOREIGN PATENT DOCUMENTS

| | | |
|---|---|---|
| 1060287 | 8/1979 | Canada . |
| 72-017630 | 10/1966 | Japan . |
| 51-030245 | 3/1976 | Japan . |
| 52-021006 | 6/1977 | Japan . |
| 52-068240 | 6/1977 | Japan . |
| 53-015093 | 5/1978 | Japan . |
| 54-013435 | 5/1979 | Japan . |
| 61-168673 | 7/1986 | Japan . |
| 3-505841 | 12/1991 | Japan . |
| 5-186889 | 7/1993 | Japan . |
| 1130687 | 10/1968 | United Kingdom . |
| WO 96/37554 | 11/1996 | WIPO . |

*Primary Examiner*—David A. Simmons
*Assistant Examiner*—Robert R. Koehler
*Attorney, Agent, or Firm*—Ernest G. Szoke; Wayne C. Jaeschke; Norvell E. Wisdom, Jr.

[57] ABSTRACT

The uniformity of gloss of a dried autodeposited resin film on a metal surface can be increased by rinsing the wet autodeposited film initially formed with an aqueous modifying rinse having a pH from 6 to 11 and comprising from 0.2 to 10.0 g/L in total of polymers of carboxylic acid monomers having an ethylenic double bond and salts thereof.

20 Claims, 1 Drawing Sheet

COMPOSITION AND PROCESS FOR AUTODEPOSITION WITH MODIFYING RINSE OF WET AUTODEPOSITED COATING FILM

TECHNICAL FIELD

The present invention relates to a method for coating a metal surface, for example a metal such as iron, zinc, iron alloys and zinc alloys, and the like, by autodeposition to form a predominantly organic coating on the surface of the metal, more particularly a coating which, besides having outstanding corrosion resistance and adhesion, also has a good appearance without any unevenness in gloss.

BACKGROUND ART

Coating compositions which enable the formation of a resin coating on a metal surface by bringing said metal surface into contact with an acidic composition which includes an organic film-forming resin are known as "autodepositing" or "autodeposition" compositions and are usually water-based. Such compositions are disclosed in Japanese Patent S47-17630, Japanese Examined Patent S52-21006, Japanese Examined Patent S54-13435 and Japanese Unexamined Laid-Open Patent Application S61-168673.

The defining characteristic of autodepositing waterbased coating compositions is that by contacting a suitable metal material having a clean surface with the coating composition, a resin coating film which increases in thickness or weight as immersion time increases forms spontaneously as a result of chemical reaction between the metal and the coating composition. (Metal ions dissolved from the metal surface are believe to interact with the resin particles and to be deposited together with them onto the metal surface.) Thus, a resin coating film can be beneficially formed on said metal surface without the need for external electromotive force, as is required in electrodeposition. However, in some cases the corrosion resistance and adhesion of an autodeposited resin coating film is not entirely satisfactory, and various means have been disclosed for improving these properties. Such means include chemical treatments of wet autodeposited coating films before they are dried. (Such chemical treatments are known by various names in the art; the most common such name is probably "final rinse", which is well-established but often a misnomer, because there may be other subsequent water rinses. Other names are "after-treatment", "post-treatment", "reaction rinse", "chemical rinse", and the one preferred herein, "modifying rinse".) The following citations exemplify such treatments.

In Japanese Examined Patent S53-15093 and U.S. Pat. No. 3,795,546 it is disclosed that by bringing a coated object into contact with an aqueous solution containing a hexavalent chromium compound and polyacrylate after immersion in an autodepositing aqueous coating composition and before hot drying the coated resin film, the corrosion resistance of the coating film after drying is raised.

In Japanese Unexamined Laid-Open Patent Application S51-30245 a method is disclosed for preventing poor appearance, such as blistering and cracking and the like, of autodeposited resin coating films after hot drying, by bringing the said resin coating film before drying into contact with an aqueous solution containing from 10–100 grams per liter (hereinafter usually abbreviated as "g/L") of a water-soluble solvent such as an alcohol, ketone, alcohol ester, ketone ester, ketone ether, or ester ether.

In Japanese Unexamined Laid-Open Patent Application S52-68240 a method is disclosed for raising the corrosion resistance of an autodeposited resin coating film formed on a coated object after hot drying by bringing said resin coating film before drying into contact with an aqueous solution or aqueous dispersion containing from 5–100 g/L in total of one or more substances selected from the group consisting of nitrogen-containing organic compounds such as amines, carboxylic acid amine salts, amino acids, melamine and amides, for example.

In Japanese Unexamined Laid-Open Patent Application H3-505841 a method is disclosed for raising the post-drying adhesion and corrosion resistance of an autodeposited resin coating film formed on a coated object by bringing said resin coating film, before hot drying, into contact with an aqueous solution of an alkaline substance.

Similarly, Japanese Unexamined Laid-Open Patent Application H5-186889 discloses a method for raising the post-drying adhesion and corrosion resistance of an autodeposited resin coating film formed on a coated object by bringing the said resin coating film before hot drying into contact with an aqueous solution with a pH from 7 to 11 containing from 0.05 to 5 percent by weight (hereinafter usually abbreviated as "wt %") of anions derived from an acid selected from 1,1-diphosphonic acid, citric acid, succinic acid and oxalic acid.

Because coating by autodeposition is generally performed by immersion, in many cases the coating liquid is prone to being initially retained in, and later to sag or run in the vicinity of, specific structural features, such as bolt holes when the coated material is to be bolted in place. In such instances, a consistent coating film appearance is not usually obtained, because there is a variation in gloss between the portions where sagging occurs and other portions. When an autodeposited resin coating film is the last or only coating employed on the coated object, this variation in gloss considerably affects the quality of the appearance of the coated object. The pre-drying modifying rinses of autodeposited resin coating films known from the art described previously are beneficial for raising the corrosion resistance of said resin films and for preventing blistering and cracking of the resin film, but have not been found to have any benefit when it comes to preventing variation in gloss. In recent years the painting of metal surfaces is being required to give greater added value, so that high corrosion resistance, high adhesion and also a uniform appearance are required, and an improvement in this appearance would be desirable.

DISCLOSURE OF THE INVENTION

PROBLEMS TO BE SOLVED BY THE INVENTION

The object of the present invention is to provide a method for coating a metal surface which enables the formation of an autodeposited resin coating film which has outstanding corrosion resistance and adhesion, and also has a good appearance without any variation in gloss.

SUMMARY OF THE INVENTION

The problem above is solved by a method for coating a metal surface which comprises forming a resin coating film on the metal surface by maintaining said metal surface in contact with an autodepositing type water-based coating composition comprising a coat-forming resin emulsion, an acid and an oxidizing agent, and, optionally, additional metal ions for a sufficient time to form a wet autodeposited film thereon, discontinuing contact between the wet autodeposited film and any part of the autodepositing type waterbased coating composition, except that which is physically incorporated into the autodeposited film, bringing said wet autodeposited film into contact with an aqueous solution which has a pH value from 6 to 11 and which, in addition to water, comprises, preferably consists essentially of, or more preferably consists of from 0.2–10.0 g/L of dissolved, dispersed, or both dissolved and dispersed polymer(s) selected from the group consisting of polymers of carboxylic acid monomers having an ethylenic double bond and salts thereof.

DETAILS OF THE INVENTION, INCLUDING PREFERRED EMBODIMENTS

Figure 1:
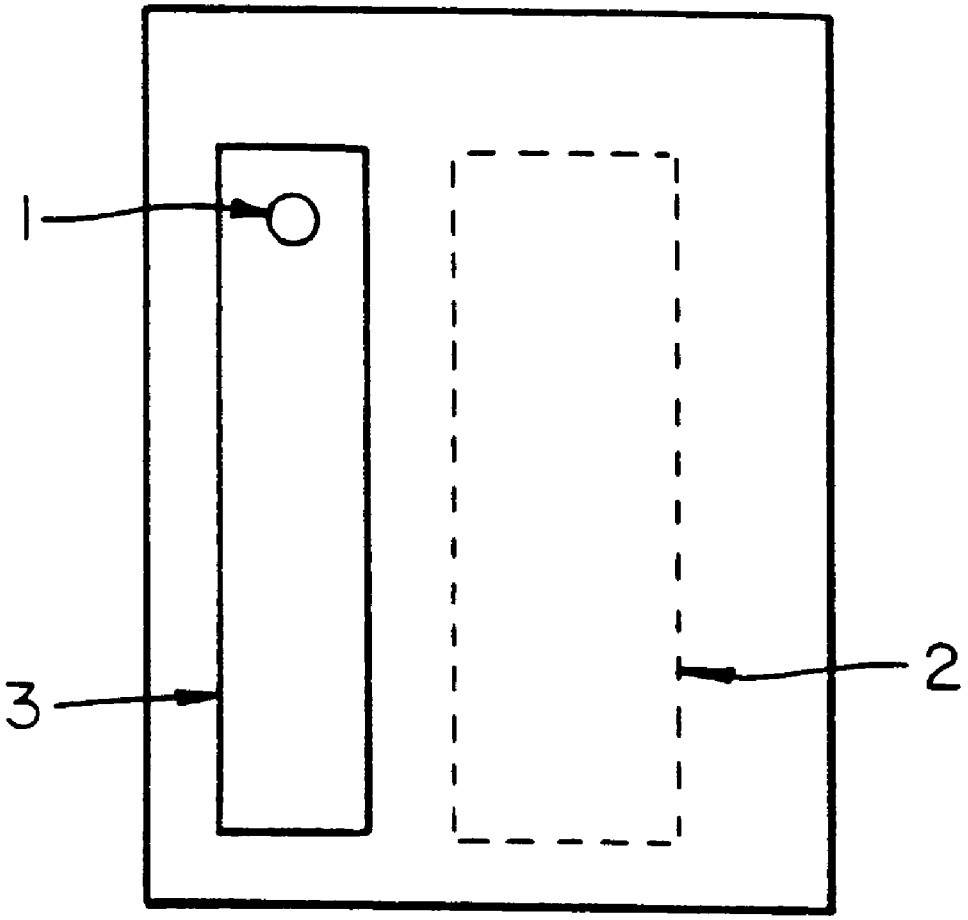
FIG. 1 is a drawing of the largest area surface of the test panels used in the examples and comparison examples, showing the positions at which gloss values were determined and the relation of these positions and their size to the position and size of a hole through the test panels.

There are no narrow restrictions as to the resin in the film-forming resin emulsion employed in the present invention, which can be any resin which is capable of satisfactory use in an autodepositing water-based coating composition. Examples include resins made from (meth) acrylic acid type monomers, which include homopolymers of (meth)acrylic acid ester monomers such as methyl acrylate, ethyl acrylate, n-butyl acrylate, 2-hydroxyethyl acrylate, 2-hydroxypropyl acrylate, 2-ethylhexyl acrylate, methyl acrylate, ethyl methacrylate, n-butyl methacrylate, 2-hydroxyethyl methacrylate, 2-hydroxypropyl methacrylate, glycidyl acrylate and glycidyl methacrylate, and the like and also acrylamide, methacrylamide, acrylonitrile, acrylic acid and methacrylic acid. Other suitable monomers include styrene, ethylene, vinyl chloride, vinylidene chloride, vinyl acetate, and the like. Other suitable resins may be copolymers from any two or more of these previously recited monomer, urethane resins, epoxy resins, and polyester resins. The resin employed in the present invention can also be any mixture of the resins above.

There are no narrow restrictions as to the molecular weight of the coat-forming resin, but, for example, the molecular weight as measured by gel permeation chromatography in tetrahydrofuran, using polystyrene or a poly (acrylic acid ester) as a reference, preferably is from 50,000 to 1,000,000, and more preferably is from 100,000 to 1,000,000.

The film-forming resin emulsion employed in the present invention can be any resin emulsion ordinarily used in preparing autodepositing water-based coating compositions; in most cases it will be a resin emulsion obtained by ordinary emulsion polymerization, but it can also be a resin emulsion formed by emulsifying in water a resin obtained by another method of polymerization.

There are also no narrow restrictions as to the conditions for polymerization to give a polymer emulsion by emulsion polymerization, and this can be performed by an ordinary method; however, as an example a film-forming resin emulsion can be obtained by subjecting a mixture comprising at least water, an anionic surfactant and/or nonionic surfactant, resin constituent monomers as noted above, and a polymerization initiator to conditions which will activate the polymerization initiator to produce a polymerization reaction.

An autodepositing waterbased coating composition employed in the present invention can be obtained by mixing a film-forming resin emulsion obtained as described above with an acid and an oxidizing agent, and if desired a compound which can supply a metal ion, and adding water if necessary.

As the acid, for example, any one or more selected from hydrofluozirconic acid, hydrofluotitanic acid, hydrofluosilicic acid, hydrofluoboric acid, hydrofluoric acid, phosphoric acid, nitric acid, and the like, can be employed, but hydrofluoric acid is preferred. As the oxidizing agent hydrogen peroxide, potassium permanganate and sodium nitrite, and the like, can be used; but hydrogen peroxide is preferred. There are no narrow restrictions as to compounds which can supply metal ions, provided that they are stable in said coating composition; examples include ferric fluoride, ferric nitrate, ferrous phosphate and cobaltous nitrate, and the like, and ferric fluoride is preferred.

The content of resin in an autodepositing water-based coating composition employed in the present invention, measured as the concentration of resin solids, is preferably from 5 to 550 g/L, and more preferably from 50 to 100 g/L. The concentration of acid is preferably from 0.1 to 5.0 g/L, and more preferably from 0.5 to 3.0 g/L; and the concentration of oxidizing agent is preferably from 0.01 to 3.0 g/L, and more preferably from 0.03 to 1.0 g/L. A compound which can supply metal ions does not have to be used, but is preferably used; when used, the concentration should be $\leqq$50 g/L, and is preferably from 1.0 to 5.0 g/L.

An autodepositing water-based coating composition employed in the present invention may also contain as optional components a film-forming aid such as trialkylpentanediol isobutyrate or alkylcarbitol, and the like, for example, in order to lower the film-forming temperature and facilitate the coalescence of the deposited resin particles, and/or a pigment such as a carbon black, phthalocyanine blue, phthalocyanine green, quinacridone red, hansa yellow, and/or benzidine yellow pigment, and the like.

Autodepositing coating compositions employed in the present invention can be used for treating surfaces of iron, zinc, iron alloy and zinc alloy, and particularly steel portions of various components such as automobile sheet components and automobile components such as shock absorbers, jacks, leaf springs, suspension components and brackets, and the like, and components of furniture such as drawer rails, and the like.

There are no narrow restrictions as to the method for contacting a metal surface using an autodepositing coating composition employed in the present invention, and any method generally applicable to surface treatment, such as immersion, spraying or roll coating, and the like, can be adopted; however, immersion is usually preferred. There are also no narrow restrictions as to the temperature of treatment or the duration of treatment; however, in the case of immersion treatment, immersion at ordinary ambient temperature, e.g. 18 to 25° C., for from 30 to 300 seconds, and preferably from 90 to 240 seconds, is generally suitable.

There are no narrow limitations as to the quantity of said coating composition applied to the metal; however, the film thickness after drying is preferably from 5 to 40 micrometers (hereinafter usually abbreviated as "$\mu$m"), and more preferably is from 20 to 30 $\mu$m.

Ordinarily a metal surface preferably is degreased and rinsed with water before applying said coating composition.

After applying said coating composition to a metal, it is preferably subjected to ordinary rinsing with water; then the modifying rinse that characterizes the present invention is performed. The rinsing with water can be performed by exposure to running water, but will ordinarily by performed by immersion for from 10 to 120 seconds, or preferably from 20 to 60 seconds, in water at ordinary ambient temperature.

As mentioned previously, a modifying rinse process of the present invention is performed by bringing the resin coating film produced as above into contact with an aqueous solution (modifying rinse solution) having a pH from 6 to 11 and containing a total of from 0.2 to 10.0 g/L of at least one polymer selected from polymers of carboxylic acid monomers having an ethylenic double bond and salts thereof. The total concentration of such polymers and salts thereof is preferably from 0.5 to 4.5 g/L, and more preferably from 1.0 to 3.0 g/L. With a concentration less than 0.2 g/L, no benefits can normally be expected in terms of preventing variation in the gloss of the coating film after drying, and on the other hand when the total concentration exceeds 10.0 g/L, the drying properties of the outermost surface of the resin coating film become uneven and this in itself tends to produce variations in gloss.

Polymers of carboxylic acid monomers having an ethylenic double bond and salts thereof include copolymers of (meth)acrylic acid with acrylate, methacrylate, and maleate ester monomers, which can be the same (meth)acrylic acid esters listed in connection with the resin in the aforementioned film-forming resin emulsion, and/or copolymers of styrene with a carboxylic acid monomer having an ethylenic double bond (acrylic acid, methacrylic acid, maleic acid, fumaric acid, itaconic acid, crotonic acid, and the like), and sodium salts and ammonium salts of these, and the like. Of these, polyacrylic acid and the ammonium salts thereof are preferred. In the case of copolymers, the weight ratio of (meth)acrylic acid ester monomer(s) and/or styrene to carboxylic acid monomer(s) having an ethylenic double bond is preferably from 1:99 to 50:50, and more preferably from 3:97 to 30:70. There are no narrow restrictions as to the molecular weight of the polymers of carboxylic acid monomers having an ethylenic double bond; however, the molecular weight is preferably from 2000 to 200,000, and more preferably from 10,000 to 50,000.

The polymer of a carboxylic acid monomer having an ethylenic double bond can be obtained by any method of polymerization; it is also possible to use a polymer purified from a polymerization liquor when making said modifying rinse solution, or the polymerization liquor itself can be used provided that it will not interfere with the purpose of the present invention.

The pH of said modifying rinse solutions needs to be from 6 to 11. A pH of 6.5 to 8.5 is preferred. With a pH less than 6.0, there is usually no benefit of preventing variation in gloss after drying, and corrosion resistance and adhesion are not usually adequate; on the other hand, when the pH exceeds 11, adhesion becomes inadequate and/or there is an undesirable etching of the metal surface coated.

As the substance used to adjust the pH of said modifying rinse solution a known substance disclosed in Japanese Unexamined Laid-Open Patent Application H3-505841 or Japanese Unexamined Laid-Open Patent Application H5-186889 preferably is used. Examples include ammonium bicarbonate, ammonium hydroxide and hydroxides of alkali metals such as sodium, potassium and lithium. Preferably at least one of ammonium bicarbonate, ammonium hydroxide and sodium hydroxide is/are used. Ammonium bicarbonate and/or ammonium hydroxide are more preferred.

There is no narrow restriction as to the modifying rinse process conditions of the present invention; a modifying rinse process according to the invention can suitably be performed by immersion at a temperature from 5 to 60° C., and preferably at ordinary ambient temperature, with a contact time of from 30 to 120 seconds, or more preferably from 60 to 90 seconds. After said modifying rinse, moisture on the coating film is evaporated and the coalescence of the resin particles preferably is accelerated by subjecting the coated object to a drying treatment. There is no narrow restriction as to this drying; in general it can preferably be performed at 60 to 200° C., or more preferably at 100 to 180° C., for a time from 5 to 30 minutes, or preferably from 10 to 20 minutes.

The present invention is explained in more detailed terms below by means of examples and comparison examples.

EXAMPLES AND COMPARISON EXAMPLES

Example 1

An autodepositing water-based coating composition prepared as noted below was held at a bath temperature of 20 to 22° C., and a pre-leaned cold-rolled steel sheet (size 70×150×1 mm) test panel having a bolt hole 1 as shown in FIG. 1 was painted by immersion in this composition for 180 seconds, rinsed by immersion in deionized water for 60 seconds, immersed for 60 seconds in Modifying Rinse Solution A below at ordinary ambient temperature, and dried for 20 minutes in a hot air oven at 110° C., and was then submitted to the tests of coating film performance described hereinafter.

Test autodepositing water-based coating composition

| Ingredient | Concentration (g/L) |
|---|---|
| Saran ™ SL-143 Latex (solids 55%) (a W. R. Grace product) | 95.00 |
| Hydrofluoric acid | 0.70 |
| Ferric fluoride | 3.00 |
| Hydrogen peroxide | 0.10 |

The above ingredients were combined with deionized water only to produce the autodepositing coating composition.

Saran™ SL-143 Latex is an emulsion containing a vinylidene chloride copolymer resin, which becomes a coat-forming resin when combined with the other ingredients listed.

Modifying Rinse Solution A

An aqueous solution of polyacrylic acid (solids 25%) (Toagosei product) diluted with deionized water to give a polyacrylic acid concentration of 2.0 g/L, and adjusted to pH 6.5 with ammonium bicarbonate, was used.

Examples 2 to 8

The procedure of Example 1 was repeated, except for using Modifying Rinse Solutions B–H, with the compositions shown in Table 1, which were prepared in the same way as Modifying Rinse Solution A, except for the different substances and/or amounts thereof used as ingredients.

TABLE 1

COMPOSITIONS AND TEST RESULTS FOR THE EXAMPLES AND COMPARISON EXAMPLES

| | Example Number: | | | | | |
|---|---|---|---|---|---|---|
| | 1 | 2 | 3 | 4 | 5 | 6 |
| Modifying Rinse Identifier Letter: | A | B | C | D | E | F |
| Carboxylic acid polymers and salts: | | | | | | |
| g/L of Polyacrylic acid[1] | 2.0 | | 1.5 | 1.0 | | |
| g/L of Ammonium polyacrylate[2] | | | 1.5 | | | 1.0 |
| b/L of Sodium polyacrylate[3] | | | | 0.5 | | 0.5 |
| g/L of Acrylic acid/ethyl acrylate copolymer[4] | | | | | 0.5 | |
| g/L of Polymaleic acid[5] | | 1.0 | | | | |
| Polyamide resin[6] | | | | | | |
| Urethane resin[7] | | | | | | |
| Substance(s) Used to Adjust pH: | | | | | | |
| Ammonium bicarbonate | Yes | | Yes | Yes | | |
| Ammonium hydroxide | | Yes | | | Yes | Yes |
| Sodium hydroxide | | | | Yes | | |
| pH | 6.5 | 7.0 | 7.6 | 8.2 | 9.0 | 9.5 |
| Dry Film thickness, μm | 22 | 20 | 23 | 23 | 20 | 22 |
| Gloss Values: | | | | | | |
| Position A | 36.2 | 34.9 | 36.1 | 35.5 | 33.8 | 35.7 |
| Position B | 36.5 | 35.2 | 36.5 | 36.0 | 36.0 | 36.5 |
| Difference, B − A | 0.3 | 0.3 | 0.4 | 0.5 | 2.2 | 0.8 |
| 500 Hour corrosion peel, mm | 5 | 5 | 5 | 6 | 5 | 6 |

| | Example Number: | | | Comparison Example Number | | |
|---|---|---|---|---|---|---|
| | 7 | 8 | 9 | 1 | 2 | 3 |
| Modifying Rinse Identifier Letter: | G | H | A | I | J | K |
| Carboxylic acid polymers and salts: | | | | | | |
| g/L of Polyacrylic acid[1] | | | 2.0 | 0.1 | | |
| g/L of Ammonium polyacrylate[2] | 3.0 | 4.5 | | | | 5.0 |
| b/L of Sodium polyacrylate[3] | | | | | 10.0 | |
| g/L of Acrylic acid/ethyl acrylate copolymer[4] | | | | | | |
| g/L of Polymaleic acid[5] | | | | | | |
| Polyamide resin[6] | | | | | | |
| Urethane resin[7] | | | | | | |
| Substance(s) Used to Adjust pH: | | | | | | |
| Ammonium bicarbonate | | | Yes | Yes | | |
| Ammonium hydroxide | | Yes | Yes | | | Yes |
| Sodium hydroxide | | | | | Yes | |
| pH | 10.0 | 10.6 | 6.5 | 8.5 | 12.9 | 11.8 |
| Dry Film thickness, μm | 23 | 22 | 22 | 22 | 20 | 22 |
| Gloss Values: | | | | | | |
| Position A | 35.1 | 36.0 | 35.1 | 27.9 | 35.5 | 34.0 |
| Position B | 35.9 | 36.5 | 35.6 | 35.7 | 36.0 | 36.5 |
| Difference, B − A | 0.8 | 0.5 | 0.5 | 7.8 | 0.5 | 2.5 |
| 500 Hour corrosion peel, mm | 6 | 6 | 4* | 5 | 6 | 6 |

TABLE 1-continued

COMPOSITIONS AND TEST RESULTS FOR THE EXAMPLES AND COMPARISON EXAMPLES

| | Comparison Example Number: | | | | | |
|---|---|---|---|---|---|---|
| | 4 | 5 | 6 | 7 | 8 | 9 |
| Modifying Rinse Identifier Letter: | L | M | N | O | P | |
| Carboxylic acid polymers and salts: | | | | | | |
| g/L of Polyacrylic acid[1] | 2.0 | 2.0 | | | | |
| g/L of Ammonium polyacrylate[2] | | | | | | |
| b/L of Sodium polyacrylate[3] | | | | | | |
| g/L of Acrylic acid/ethyl acrylate copolymer[4] | | | | | | |
| g/L of Polymaleic acid[5] | | | | | | |
| Polyamide resin[6] | 2.0 | | | | | |
| Urethane resin[7] | | | | 5.0 | | |
| Substance(s) Used to Adjust pH: | | | | | | |
| Ammonium bicarbonate | | Yes | Yes | Yes | Yes | |
| Ammonium hydroxide | | | | | | |
| Sodium hydroxide | | | | | | |
| pH | 2.8 | 5.6 | 7.5 | 8.6 | 7.3 | — |
| Dry Film thickness, μm | 20 | 23 | 20 | 22 | 23 | 20 |
| Gloss Values: | | | | | | |
| Position A | 25.5 | 26.0 | 22.2 | 21.8 | 25.0 | 27.9 |
| Position B | 36.0 | 36.2 | 34.6 | 32.5 | 36.0 | 35.7 |
| Difference, B − A | 10.5 | 10.2 | 12.4 | 10.7 | 11.0 | 7.8 |
| 500 Hour corrosion peel, mm | 8 | 7 | 6 | 7 | 5 | 5* |

Footnotes for Table 1

[1]Product of Toagosei Chemical Industries.

[2]Product of Toagosei Chemical Industries.

[3]Product of Toagosei Chemical Industries.

[4]Product of Rohm & Haas.

[5]Product of Nippon Shokubai

[6]Product of Toray; water soluble, with a molecular weight of about 20,000.

[7]Product of Kai-ichi Kogyo Seiyaku; a self-emulsifying anionic resin.

*Peel width value is for 192 hours instead of 500 hours.

General Note for Table 1

All test panels had 100% ratings for adhesion on both tests a and b. However, in Comparison Examples 2–5; there was etching of the test samples revealed by test b; no such etching was apparent on any of the other samples.

Comparison Examples 1–8

The procedure of Example 1 was repeated, except for using Modifying Rinse Solutions I–P with the compositions shown in Table 1, prepared in the same way as Modifying Rinse Solution A, except for the different substances and/or amounts thereof used as ingredients.

Example 9

An autodepositing water-based coating composition prepared according to the formula below was held at a bath temperature of 20 to 22° C., and a precleaned cold-rolled steel sheet (size 70×150×1 mm) having a bolt hole as shown in FIG. 1 was painted by immersion in this for 180 seconds as a test panel, rinsed by immersion in deionized water for 90 seconds, immersed for 60 seconds in Modifying Rinse Solution A at ordinary ambient temperature and dried for 20 minutes in a hot air oven at 180° C., and was then submitted to the tests of coating film performance described hereinafter.

Autodepositing water-based coating composition for Example 9

| Ingredient | Concentration (g/L) |
|---|---|
| Film-forming resin emulsion from below | 250.00 |
| Film-forming aid A from below | 4.00 |
| Hydrofluoric acid | 0.70 |
| Hydrogen peroxide | 0.10 |

Film-forming aid A was trialkylpentanediol isobutyrate; its addition gave a minimum film-forming temperature in the vicinity of 20° C.

The film-forming emulsion was made as follows: A monomer mixture comprising methacrylic acid 2 parts (which are parts by weight, here and hereinafter), methyl methacrylate 28 parts, acrylonitrile 30 parts, ethyl acrylate 20 parts, and butyl acrylate 20 parts was mixed with 1.0 part of an acrylic acid ester type reactive surfactant in an amount of 1.0 wt % of the total weight of the previous five monomers, 0.3 part of ammonium persulfate and 399.6 parts of deionized water, and emulsion polymerized by a conventional method at 75° C. for 4 hours to make a dispersion including 20% of polymer resin solids. This dispersion was then cooled to 40° C., mixed with additional deionized water and the other ingredients noted above and adjusted to pH 5 to 8, then finally adjusted with additional deionized water so as to produce a volume that gave the concentrations specified above for the various active ingredients, to give the coat-forming resin dispersion.

Comparison Example 9

The autodepositing water-based coating composition used in Example 9 was held at a bath temperature of 20 to 22° C., and a precleaned cold-rolled steel sheet (size 70×150×1 mm) having a bolt hole as shown in FIG. 1 was painted by immersion in this for 180 seconds as a test panel, rinsed by immersion in deionized water for 90 seconds and dried for 20 minutes in a hot air oven at 180° C., and was then submitted to the tests of coating film performance described hereinafter.

The methods for testing the performance of the coating films were as follows:

(1) Film thickness

The thickness of the coating film was determined at 3 points at the top, in the middle and at the bottom of the test sheet, and the mean value of these three measurements was calculated and reported.

(2) Gloss values of the coating film

The gloss values of the coating film, specifically 60° mirror surface reflection values, were determined at three points at the top, in the middle and at the bottom of each of Zone A, the surface inside dotted line 2, and Zone B, the surface inside solid line 3, both as shown in FIG. 1, using a digital variable-angle gloss meter (Suga Test Instruments Model UGV-5K), and the mean values for the two zones were calculated and reported, along with the difference between the mean values for the two zones.

(3) Coating film adhesion (cross-hatch tape peel test)

Before and after immersion in warm water at 40° C. for 240 hours, one hundred 1-mm squares were cut in the test sheet, and the number of squares of paint film remaining after peeling with a tape were determined.

(4) Corrosion resistance

The coating film on the test sheet was cross-cut down to the bare metal, and then submitted to salt spray test (JIS Z-2371) for 500 hours. After the test it was peeled with a tape, and the maximum width on either side that peeled from the cross-cut part was determined and reported in millimeters ("mm").

Results of all of the coating film performance tests are shown in Table 1, from which it is clearly evident that in Examples 1 through 9 in which the coating method of the present invention was used, the coating film after drying had outstanding corrosion resistance, adhesion, and little or no variation in gloss. By contrast, there was a large variation in gloss in Comparison Example 1 in which the polyacrylate concentration of the modifying rinse solution was low; and, although the appearance of the coating film was good in Comparison Examples 2 and 3, in which the pH of the modifying rinse solution exceeded 11, undesirable etching of the metal was revealed by the test of the adhesion of the coating film after immersion in warm water. In Comparison Examples 4 and 5, in which the pH of the modifying rinse solution was less than 6, the corrosion resistance of the coating film and its adhesion after immersion in warm water were inferior, and the coating film had a variable gloss. In Comparison Examples 6 and 7, in which an organic resin other than a polymer of a carboxylic acid monomer having an ethylenic double bond or a salt thereof was used, and in Comparison Example 8 in which ammonium bicarbonate was used on its own as a modifying rinse solution, variations in gloss were produced in the coating film. Variations in the gloss of the coating film were also produced in Comparison Example 9, in which no modifying rinse solution was employed.

Benefits of the Invention

By using the method of the present invention for coating a metal surface, an autodeposited resin coating film can be obtained which has outstanding corrosion resistance and adhesion and in addition also has a better appearance than coating films obtained by prior methods, without any substantial variation in gloss.

The Invention claimed is:

1. A process for coating a metal surface, said process comprising steps of:

(I) bringing said metal surface into contact with an autodepositing water-based coating composition comprising water and (A) a coat-forming resin dispersed in the composition, (B) an acid, and (C) an oxidizing agent, and, optionally, (D) metal ions and maintaining contact between said coating composition and said metal surface for a sufficient time that a wet autodeposited film forms on said metal surface;

(II) discontinuing contact between said wet autodeposited film and any of said coating composition that is not physically incorporated into said wet auto-deposited film;

(III) contacting the wet autodeposited film formed in steps (I) and (II), while it is still wet, with an aqueous modifying rinse composition having a pH value from 6 to 11 and comprising a total of from 0.2 to 10.0 g/L of polymer molecules selected from the group consisting of (i) homopolymer molecules and copolymer molecules of carboxylic acid monomers having an ethylenic double bond and (ii) salts of the polymer molecules as recited in part (i), so as to produce a modified wet autodeposited film;

(IV) discontinuing contact between said modifed wet autodeposited film and any of said aqueous modifying rinse composition that is not physically incorporated into said modified wet autodeposited film; and (V) hot drying the modifed wet autodeposited film formed in steps (III) and (IV), so as to convert the modified wet autodeposited film into an adherent dry autodeposited coating on the metal surface.

2. A process according to claim 1, also comprising a step (II') of rinsing the wet autodeposited resin film formed in step (II) with water before performing step (III).

3. A process according to claim 2, wherein, in the autodepositing water-based coating composition used in step (I), the coat-forming resin has a molecular weight in a range from 100,000 to 1,000,000 and is present in a concentration from 50 to 100 g/L.

4. A process according to claim 3, wherein, in the autodepositing water-based coating composition used in step (I), acid is present in a concentration from 0.5 to 3.0 g/L and oxidizing agent is present in a concentration from 0.03 to 1.0 g/L.

5. A process according to claim 2, wherein, in the autodepositing water-based coating composition used in step (I), acid is present in a concentration from 0.5 to 3.0 g/L and oxidizing agent is present in a concentration from 0.03 to 1.0 g/L.

6. A process according to claim 1, wherein, in the autodepositing water-based coating composition used in step (I), acid is present in a concentration from 0.1 to 5.0 g/L and oxidizing agent is present in a concentration from 0.01 to 3.0 g/L.

7. A process according to claim 6, wherein, in the modifying rinse solution, polymer molecules selected from the group consisting of polymer molecules of acrylic acid and ammonium salts thereof are present in a total concentration from 0.5 to 4.5 g/L.

8. A process according to claim 7, wherein, in the autodepositing water-based coating composition used in step (I), the acid is hydrofluoric acid and the oxidizing agent is hydrogen peroxide.

9. A process according to claim 5, wherein, in the modifying rinse solution, polymer molecules selected from the group consisting of polymer molecules of acrylic acid and ammonium salts thereof are present in a total concentration from 1.0 to 3.0 g/L and have a molecular weight from 10,000 to 50,000.

10. A process according to claim 4, wherein, in the modifying rinse solution, polymer molecules selected from the group consisting of polymer molecules of acrylic acid and ammonium salts thereof are present in a total concentration from 1.0 to 3.0 g/L and have a molecular weight from 10,000 to 50,000.

11. A process according to claim 3, wherein, in the modifying rinse solution, polymer molecules selected from the group consisting of polymer molecules of acrylic acid and ammonium salts thereof are present in a total concentration from 1.0 to 3.0 g/L and have a molecular weight from 10,000 to 50,000.

12. A process according to claim 2, wherein, in the modifying rinse solution, polymer molecules selected from the group consisting of polymer molecules of acrylic acid and ammonium salts thereof are present in a total concentration from 1.0 to 3.0 g/L and have a molecular weight from 10,000 to 50,000.

13. A process according to claim 1, wherein, in the modifying rinse solution, polymer molecules selected from the group consisting of polymer molecules of acrylic acid and ammonium salts thereof are present in a total concentration from 0.5 to 4.5 g/L.

14. A process according to claim 13 wherein, in the autodepositing water-based coating composition used in step (I), the acid is hydrofluoric acid and the oxidizing agent is hydrogen peroxide.

15. A process according to claim 12, wherein, in the autodepositing water-based coating composition used in step (I), the acid is hydrofluoric acid and the oxidizing agent is hydrogen peroxide.

16. A process according to claim 11, wherein, in the autodepositing water-based coating composition used in step (I), the acid is hydrofluoric acid and the oxidizing agent is hydrogen peroxide.

17. A process according to claim 10, wherein, in the autodepositing water-based coating composition used in step (I), the acid is hydrofluoric acid and the oxidizing agent is hydrogen peroxide.

18. A process according to claim 9, wherein, in the autodepositing water-based coating composition used in step (I), the acid is hydrofluoric acid and the oxidizing agent is hydrogen peroxide.

19. A process according to claim 4, wherein, in the autodepositing water-based coating composition used in step (I), the acid is hydrofluoric acid and the oxidizing agent is hydrogen peroxide.

20. A process according to claim 1, wherein, in the autodepositing water-based coating composition used in step (I), the acid is hydrofluoric acid and the oxidizing agent is hydrogen peroxide.

* * * * *